US005243656A

United States Patent [19]

Tanida et al.

[11] Patent Number: 5,243,656

[45] Date of Patent: Sep. 7, 1993

[54] AUDIO CIRCUIT

[75] Inventors: Kikuo Tanida, Tokyo; Isao Kunimoto, Saitama; Kazumi Shoji, Kanagawa, all of Japan

[73] Assignee: Sony Corporation, Tokyo, Japan

[21] Appl. No.: 814,823

[22] Filed: Dec. 31, 1991

[30] Foreign Application Priority Data

Jan. 9, 1991 [JP] Japan ..... 3-000779

[51] Int. Cl.[5] ..... H04R 5/02

[52] U.S. Cl. ..... 381/24; 381/28; 381/89; 381/90

[58] Field of Search ..... 381/24, 28, 89, 90

[56] References Cited

U.S. PATENT DOCUMENTS 3,394,227 7/1968 Hopengarten et al. ..... 381/28
4,186,273 1/1980 Dodson ..... 381/28
4,204,092 5/1980 Bruney ..... 381/24
4,218,583 8/1980 Poulo ..... 381/90
4,837,825 6/1989 Shivers ..... 381/24

FOREIGN PATENT DOCUMENTS 2074427 10/1981 United Kingdom ..... 381/27

*Primary Examiner*—Jin F. Ng
*Assistant Examiner*—Edward Lefkowitz
*Attorney, Agent, or Firm*—Lewis H. Eslinger; Jay H. Maioli

[57] ABSTRACT

In a multi-channel audio circuit, a plurality of input signals are supplied to corresponding amplifiers each respectively connected to speakers, at least one of the input signals being inverted. The speaker connected to the amplifier receiving the inverted signal is connected at a polarity opposite that of the other speakers.

13 Claims, 3 Drawing Sheets

FIG. 3(a)
FIG. 3(b)
FIG. 3(c)
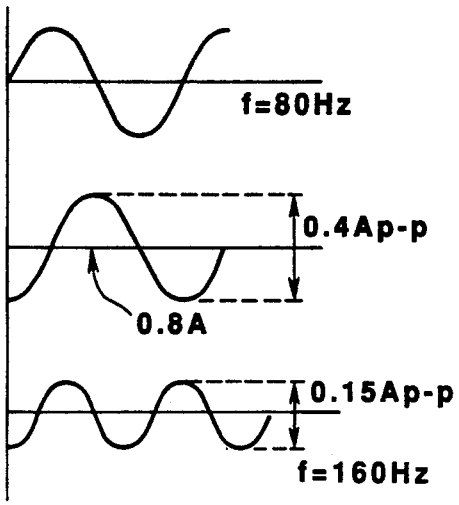
FIG. 4
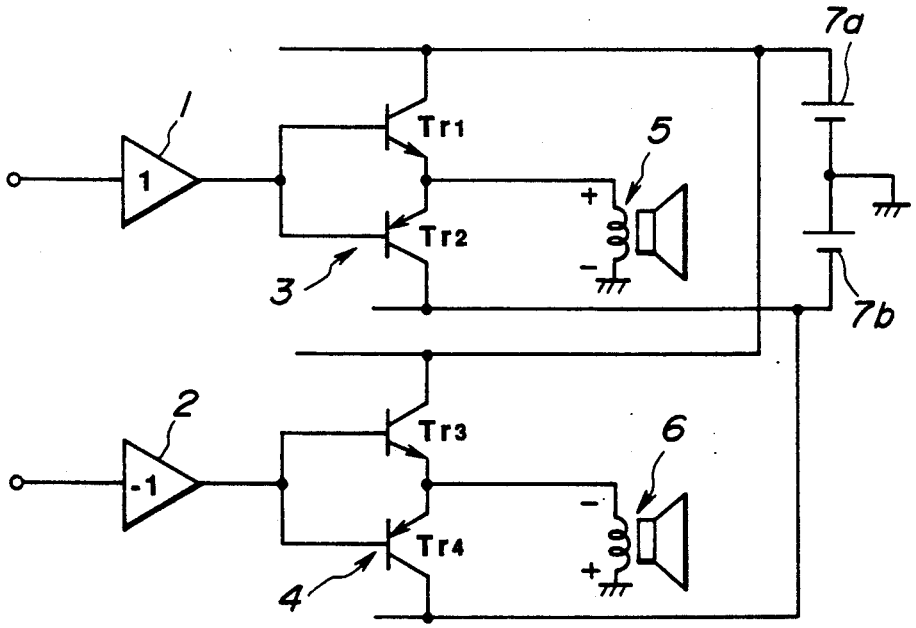

AUDIO CIRCUIT

BACKGROUND OF THE INVENTION

1. Field of The Invention

The present invention relates generally to an audio circuit. Particularly, the present invention relates to an audio circuit applicable at an output stage for multi-channel systems.

2. Description of The Background Art

Conventionally, in stereo sound systems for reproducing program material in two channels, amplifiers are paired circuits and left and right input channels are input in phase to drive the speakers. However, variation in the input signals to the amplifier cause fluctuation in the current to the amplifier from the power source. Since the amplifier must output sufficient power to cover fluctuation for two channels, a power source circuit becomes large and heavy, which raises manufacturing costs and limits design options. In systems of more than two channels, this problem is compounded.

SUMMARY OF THE INVENTION

It is a therefore an object of the present invention to provide an audio circuit which reduces ripple current subjected to a power source and to provide an audio circuit which allows a smaller power source to be utilized.

In order to accomplish the aforementioned and other objects, an audio circuit is provided comprising: amplification means, including a plurality of amplifiers respectively receiving a corresponding input signal from a signal source, at least one of the amplifiers being an inverted amplifier for inverting at least one of the signals; and a plurality of transducing means respectively corresponding to each amplifier for receiving signals output from the amplifiers for converting the signals into vibratory energy, a transducing means corresponding to the inverted amplifier being connected at a polarity opposite that of the other transducing means.

According to another aspect of the present invention, a multi-channel audio circuit is provided comprising: filtering means for providing selected frequencies for a left input signal, a right input signal and a combined left and right input signal; amplification means, including a left amplifier for receiving the left input signal, a right amplifier for receiving the right input signal, one of the left or right amplifiers being an inverted amplifier for inverting at least one of the left or right input signals; and a plurality of transducing means respectively receiving the left input signal, the right input signal, and a combination of both of the left and right input signals, a polarity of the transducing means receiving the inverted left or right signal being opposite a polarity of the transducing means receiving the non-inverted left or right signal.

According to a still further aspect of the present invention a 3-D multi-channel audio system is provided, comprising: a power source; means for producing left and right stereo input signals; filtering means for providing selected frequencies for a left input signal, a right input signal and a combined left and right input signal; amplification means, including, a left amplifier for receiving the left input signal, a right amplifier for receiving the right input signal, one of the left or right amplifiers being an inverted amplifier for inverting at least one of the left or right input signals; power amplifiers for each of the left, right, and combined left and right input signals, respectively; and a plurality of transducing means respectively receiving the left input signal, the right input signal, and a combination of both of the left and right input signals, a polarity of the transducing means receiving the inverted left or right signal being opposite a polarity of a transducing means receiving the non-inverted left or right signal.

BRIEF DESCRIPTION OF THE DRAWINGS

In the drawings:

FIGS. 3*a*–3*c*, is a graph showing an input audio signal in relation to a convention al power source current strength and a power source current strength according to the invention.

FIG. 4, is circuit diagram of a third embodiment of an audio circuit according to the present invention.

DESCRIPTION OF THE PREFERRED EMBODIMENT

Figure 1:
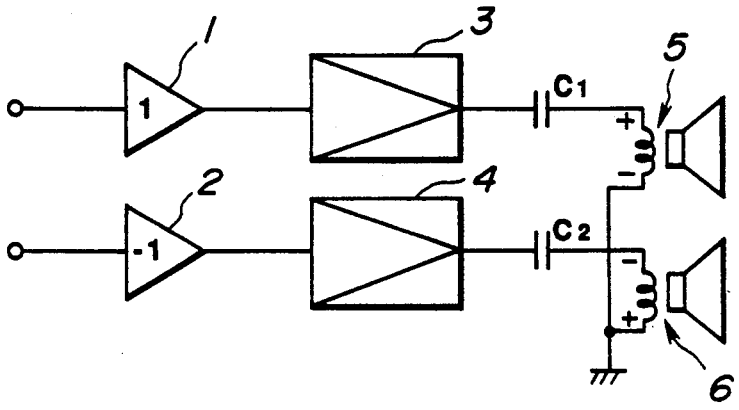
FIG. 1, is a block diagram of an audio system according to the present invention.

Referring now to the drawings, FIG. 1 is a circuit diagram of a first embodiment according to the present invention. This embodiment is applied to a two channel audio circuit. The circuit consists of a signal amplifier 1, an inverted signal amplifier 2, power amplifiers 3, 4 speakers 5, 6 and condensers $C_1$ and $C_2$. One input channel, $I_{N1}$, is connected to the gain amplifier 1 and fed to power amplifier 3. The power amplifier 3 is connected through condenser $C_1$ to the positive (+) terminal of the speaker 5. The other input channel, $IN_2$ is connected through the inverted amplifier 2 to the other power amplifier 4. The output of the power amplifier 4 is fed through condensor $C_2$ to the negative (−) terminal of the speaker 6. The (−) terminal of speaker 5 and the (+) terminal of speaker 6 are connected to ground. It will be noted that the polarities of speakers 5 and 6 are reversed.

According to the above arrangement, $IN_1$ and $IN_2$ combine to provide stereo reproduction of the source material. Additionally, since low frequency sounds are often nearly identical for both left and right channels, a third amplifier may be implemented for only the low frequencies of both left and right channels to form the basis for a 3-D sound system as will be explained in detail hereinlater.

Figure 2:
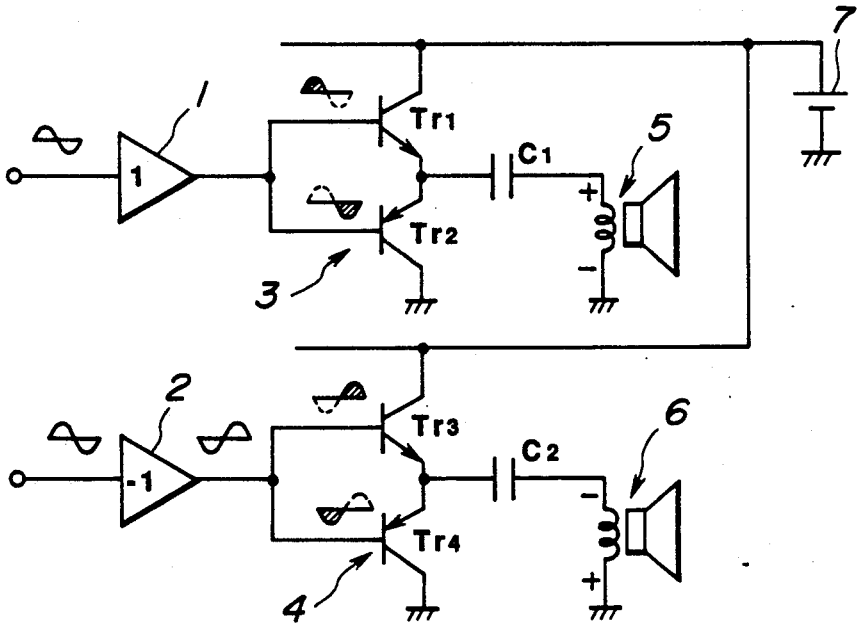
FIG. 2, is a circuit diagram of a second embodiment of an audio circuit according to the invention.

FIG. 2 shows a second embodiment of an audio circuit according to the present invention. In this embodiment, as shown in FIG. 2, each power amplifier of a 2 channel audio system is arranged with a push-pull circuit. The audio circuit of this embodiment comprises a signal amplifier 1, an inverted signal amplifier 2, power amplifiers 3 and 4, speakers 5, 6, power source 7 and condensers $C_1$ and $C_2$. At the power amplifier 3, between the positive terminal of the power source 7 and ground, an npn transistor Tr1 and a pnp transistor Tr2 are connected in series. The bases of each transistor are connected to the output of amplifier 1 and the collector of Tr1 is connected to the positive terminal of the power source 7 while the collector of Tr2 is connected to ground. Each emitter is connected commonly through the condenser $C_1$ to the positive terminal of the speaker 5. On the other hand, as for the power amplifier 4, transistors Tr3 (npn) and Tr4 (pnp) are connected in series between the positive pole of the power source 7 and ground, while the bases of both Tr3 and Tr4 are connected to the output of inverted power amplifier 2. The collector of Tr3 is connected to the positive terminal of the power source 7 while the collector of Tr4 is connected to ground. The emitters of Tr3 and Tr4 are commonly connected to the negative (−) terminal of the speaker 6 via the condenser $C_2$. Meanwhile, the negative terminal of speaker 5 and the positive terminal of speaker 6 are connected to ground.

According to the above-described construction of the second embodiment and as shown in FIG. 2, with an input IN1 which cyclically varies from positive to negative, the transistor Tr1 of power amplifier 3 is ON in the positive half and OFF in the negative half of each cycle. On the other hand, Tr2 is OFF in the positive half and ON in the negative half of each cycle. Therefore, during the positive half of each cycle the connection arrangement is as follows: power source 7>Tr1>$C_1$>speaker 5>ground, thereby storing a charge in $C_1$. During the negative half cycle of each period, the charge from $C_1$ is discharged through a loop arranged as follows: Tr2>ground>speaker 5>back to $C_1$.

The power amplifier 4, receiving IN2, is set up reciprocally to the above. In other words, since the signal IN2 is inverted by the inverting amplifier 2 and in a case where the cyclic frequency of IN2 is identical to IN1, during a positive half cycle of IN2, Tr3 will be OFF, Tr4 will be ON and during a negative cycle of IN2, Tr3 will be ON and Tr4 will be OFF. Therefore, during a positive half cycle of IN2, current from the power source 7 will not flow while during a negative half cycle, current will flow. As a result, since the input signal frequencies are reciprocal at every half cycle ripple caused at the the power source 7 will be considerably reduced, as will the maximum power expenditure required. Thus according to the above, a power transformer for powering an apparatus utilizing the arrangement of the invention may be made smaller and lighter and may be produced at lower cost.

To fully explain the above, FIG. 3 shows (a) an input signal, (b) a current signal from a power source of an audio circuit according to the prior art and, (c) a current signal from a power source for an apparatus utilizing the circuit of the invention. For example, if speakers 5 and 6 are 8Ω and the input signal is 80 Hz, a current signal according to the conventional art will display 0.4 A peak-to-peak ripple. However, according to the present invention a peak-to-peak ripple of only 0.15 A is incurred, less than half that of conventional arrangements.

FIG. 4 shows a third embodiment of a circuit according to the present invention. Whereas, the above-described second embodiment is applicable to a single power source apparatus, the third embodiment is adapted to a device utilizing double power sources, otherwise the numbering of components will be the same and description of like parts of the previous embodiments will be omitted for brevity.

According to this embodiment, condensers $C_1$ and $C_2$, utilized in the second embodiment, are not required. Furthermore, in the present embodiment, the emitters of Tr1 and Tr2 are connected directly to the positive (+) terminal of speaker 5 whereas the emitters of Tr3 and Tr4 are connected directly to the negative (−) terminal of speaker 6. The collectors of Tr1 and Tr3 are connected to the positive pole of a positive power source 7*a*, while the collectors of Tr2 and Tr4 are to the negative pole of a negative power source 7*b*. The negative pole of the positive power source 7*a* is connected to ground via the positive pole of the negative power source 7*b*, otherwise the arrangement is the same as that of the second embodiment.

In the above-described arrangement, according to the cycles of input signals IN1 and IN2, during a positive half cycle Tr1 and Tr4 become ON, while during a negative half cycle Tr2 and Tr3 become ON. Further, during the positive half cycle, positive power source 7*a* supplies power amplifier 3 and negative power source 7*b* supplies power amplifier 4 while, during the negative half cycle the current is inverted. Therefore, each power source 7*a* and 7*b* always supplies power to one of the power amplifiers 3 and 4 and further, according to the above construction, a size of each of the power sources 7*a* and 7*b* can be significantly reduced.

Next a fourth embodiment of an audio circuit according to the present invention will be explained which employs a third speaker for a 3-D audio effect.

Figure 5:
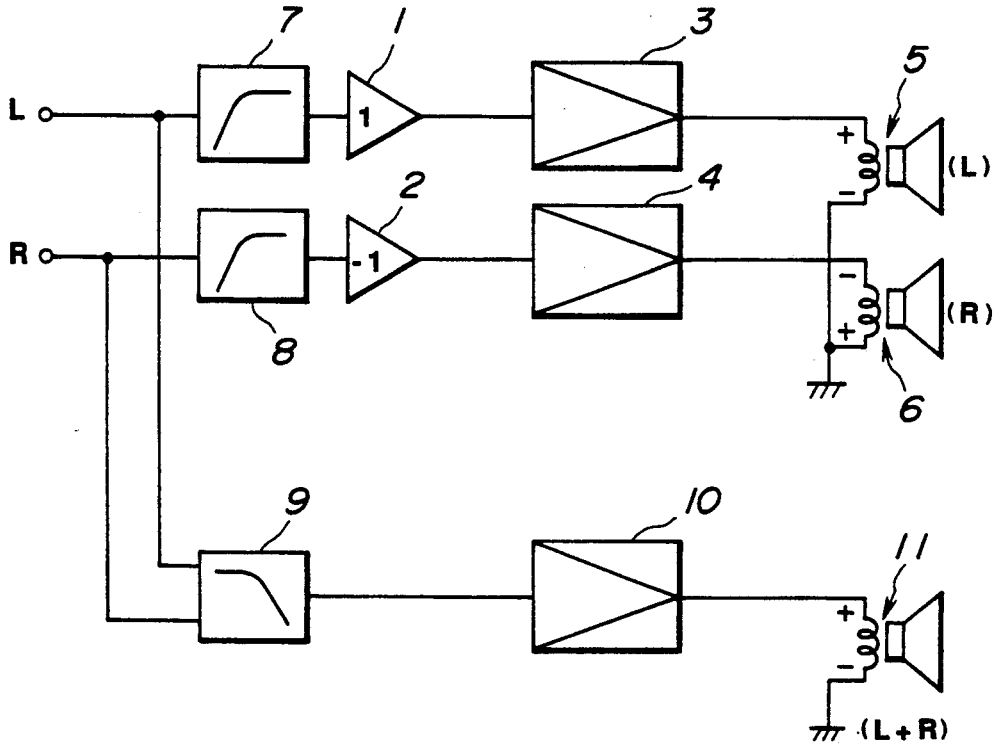
FIG. 5, is a block diagram of a 3-D audio system according to the present invention.

Referring to FIG. 5, signal amplifiers 1 and 2, power amplifiers 3 and 4, and speakers 5 and 6 are identical to the previous embodiment and will not be explained again in detail. In the present embodiment namely at the input stage, before the left (L) and right (R) channel signals are input into the amplifier 1 and the inverted amplifier 2, they are passed through high-pass filters 7 and 8 through which middle and high frequencies, for example, are passed. Further, a third signal, comprised of both L and R signals combined, is passed through a low-pass filter 9 to allow bass frequencies, for example, to pass to a third power amplifier 10 and therethrough to a third speaker 11.

In the above-described embodiment, even though the lower frequencies of both L and R channels are supplied to amplifier 10, since one of the the mid-range and high L and R channels, the R channel for example, is provided with the inverted amplifier in the arrangement according to the present invention, as described in the previous embodiment, load fluctuation due to the presence of the third (bass) channel is significantly reduced. This embodiment is particularly effective in reducing fluctuation in the vicinity of the cross-over frequency between the low-pass filter 9 and the high-pass filters 7 and 8. Thus, even for 3-D audio systems, or systems with more than two channels, a size of a power transformer, or power source can be reduced.

Thus, according to the above invention, power source ripple can be significantly reduced and utilization of the circuit of the invention further allows smaller power sources to be employed. This reduces manufacturing costs and increases design flexibility.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An audio circuit comprising:

amplification means, including a plurality of amplifiers respectively receiving a corresponding input signal from a signal source, at least one of said amplifiers being an inverted amplifier for inverting at least one of said signals and two of said amplifiers being power amplifiers formed of push-pull circuits;

a plurality of transducing means respectively corresponding to each power amplifier for receiving signals output from said amplifiers for converting said signals into vibratory energy, a transducing means corresponding to said inverted amplifier being connected at a polarity opposite that of the other transducing means; and further including a plurality of power sources including a positive power source connected to respective, opposite phase transistors in each of said push-pull circuits of each power amplifier and a negative power source connected to respective opposite phase transistors in each of said push-pull circuits of each power amplifier, the transistors connected to the positive power source being different from those connected to said negative power source and, said positive and negative power sources being connected at opposite polarities.

2. An audio circuit as set forth in claim 1, wherein said transducing means are loudspeakers.

3. An audio circuit as set forth in claim 1, wherein said amplification means further includes power amplifiers for each of said input signals, respectively.

4. An audio circuit as set forth in claim 1, wherein said input signals are two-channel stereo signals.

5. A multi-channel audio circuit comprising:

filtering means for providing selected frequencies for a left input signal, a right input signal and a combined left and right input signal;

amplification means, including a left amplifier for receiving said left input signal, a right amplifier for receiving said right input signal, one of said left or right amplifiers being an inverted amplifier for inverting at least one of said left or right input signals and further including left, right, and combined power amplifiers comprised of push-pull circuits;

a plurality of transducing means respectively receiving said left input signal, said right input signal, and a combination of both of said left and right input signals through said left, right, and combined power amplifiers, respectively, a polarity of a transducing means receiving said inverted left or right signal being opposite a polarity of a transducing means receiving said non-inverted left or right; and further including a positive power source connected to respective, opposite phase transistors in each of said push-pull circuits of said left power amplifier receiving said left input signal and a negative power source connected to respective opposite phase transistors in each of said push pull circuits of said right power amplifier receiving said right input signal, the transistors connected to the positive power source being different from those connected to said negative power source and, said positive and negative power sources being connected at opposite polarities.

6. A multi-channel audio circuit as set forth in claim 5, wherein said transducing means are loudspeakers.

7. A multi-channel audio circuit as set forth in claim 5, further including power amplifiers for each of said left, right, and combined left and right input signals, respectively.

8. A multi-channel audio circuit as set forth in claim 7, wherein said power amplifiers are connected between said amplification means and said transducing means.

9. A multi-channel audio circuit as set forth in claim 5, wherein said filtering means provides identical frequencies for said left and right input signals and other frequencies for said combined left and right input signal.

10. A multi-channel audio circuit as set forth in claim 5, wherein said filtering means is comprised of a high-pass filter for each of said left and right input signals and a low-pass filter for said combined left and right input signal.

11. A multi-channel audio circuit as set forth in claim 5, wherein a polarity of said transducing means receiving said combined left and right input signal is the same as said transducing means receiving said noninverted left or right input signal.

12. A 3-D multi-channel audio system comprising;

a power source;

means for producing left and right stereo input signals;

filtering means for providing selected frequencies for a left input signal, a right input signal and a combined left and right input signal;

amplifier means, including a left amplifier for receiving said left input signal, a right amplifier for receiving said right input signal, one of said left or right amplifiers being an inverted amplifier for inverting at least one of said left or right input signals;

power amplifiers comprised of push-pull circuits for each of said left, right, and combined left and right input signals, respectively; and a plurality of transducing means respectively receiving said left input signal, said right input signal, and a combination of both of said left and right input signals, through said power amplifiers a polarity of a transducing means receiving said inverted left or right signal being opposite a polarity of a transducing means receiving said non-inverted left or right signal, wherein said power source includes a positive power source connected to respective, opposite phase transistors in each of said push-pull circuits of said power amplifier for said left input signal and a negative power source connected to respective opposite phase transistors in each of said push-pull circuits of said power amplifier for said right input signal, the transistors connected to the positive power source being different from those connected to said negative power source and, said positive and negative power sources being connected at opposite polarities.

13. A multi-channel audio circuit as set forth in claim 12, wherein said transducing means are loudspeakers.

* * * * *